US005738940A

United States Patent [19]

Neuert

[11] Patent Number: 5,738,940

[45] Date of Patent: Apr. 14, 1998

[54] CUT-RESISTANT ARAMID FIBERS, YARNS COMPRISING THESE ARAMID FIBERS AND USE THEREOF

[75] Inventor: Richard Neuert, Winkelhaid, Germany

[73] Assignee: Hoechst Trevira GmbH & Co KG, Germany

[21] Appl. No.: 800,530

[22] Filed: Feb. 18, 1997

[30] Foreign Application Priority Data

Feb. 15, 1996 [DE] Germany ..... 196 05 511.3

[51] Int. Cl.[6] ..... B02G 3/00; E02D 27/42

[52] U.S. Cl. ..... 428/372; 428/395; 51/298

[58] Field of Search ..... 428/364, 395, 428/372, 370; 51/298

[56] References Cited

U.S. PATENT DOCUMENTS

| | | | |
|---|---|---|---|
| 5,296,543 | 3/1994 | Kasowski et al. . | |
| 5,571,891 | 11/1996 | Jung et al. | 428/395 |
| 5,589,265 | 12/1996 | Neuert et al. | 428/391 |
| 5,597,649 | 1/1997 | Sandor et al. | 428/370 |
| 5,646,234 | 7/1997 | Jung et al. | 428/395 |

FOREIGN PATENT DOCUMENTS

| | | |
|---|---|---|
| 0599231 | 6/1994 | European Pat. Off. . |
| WO 95/31593 | 11/1995 | WIPO . |
| WO 96/41042 | 12/1996 | WIPO . |

*Primary Examiner*—Newton Edwards
*Attorney, Agent, or Firm*—Connolly & Hutz

[57] ABSTRACT

Cut-resistant fibers comprise a filler having a Mohs hardness of at least 3 and a fiber-forming material comprising selected aromatic polyamides soluble in polar aprotic organic solvents. The fibers are useful for manufacturing protective clothing.

19 Claims, No Drawings

CUT-RESISTANT ARAMID FIBERS, YARNS COMPRISING THESE ARAMID FIBERS AND USE THEREOF

BACKGROUND OF THE INVENTION

1. Description

Cut-resistant aramid fibers, yarns comprising these aramid fibers and use thereof.

The present invention relates to aramid fibers having an improved cut resistance.

Fiber-forming polymers for melt spinning are customarily admixed with solids, such as titanium dioxide or colloidal quartz, as delusterants. Similarly, the addition of other solids, for example for creating magnetic properties, is known per se. Examples thereof may be found in JP-A-55-098,909 or in JP-A-3-130,413. The use of such delusterants in solvent-spun aramid fibers has hitherto not been customary.

The addition of metals in the manufacture of protective clothing has likewise already been described. Such products are disclosed for example in U.S. Pat. No. 2,328,105 or U.S. Pat. No. 5,020,161.

Cut-resistant gloves have likewise already been described. U.S. Pat. Nos. 4,004,295, -4,384,449, -4,470,251 and EP-A-458,343 disclose gloves consisting of high strength fibers or made of yarns comprising metal wires.

EP-A-599,231 discloses fibers comprising liquid-crystalline polymers including fillers having a Mohs hardness of at least 3. This reference also mentions liquid-crystalline aromatic polyamides, inter alia, for use as fiber-forming material.

Aromatic polyamides (aramids) are well known raw materials of high thermal and chemical stability and also low flammability. For instance, fibers and films composed of such raw materials have very good mechanical properties, such as high strength and high initial modulus (modulus of elasticity), and are highly useful for technical applications—for example for reinforcing plastics or as filter materials.

It is known that filaments or fibers can be produced from polyaramids with high strength and high initial modulus if the amide bonds on the aromatic nuclei are coaxial or almost parallel to each other, which results in rigid, rodlike polymer molecules. A typical polyamide of this type is, for example, poly(p-phenyleneterephthalamide).

In addition to such aromatic polyamides, which, because they are insoluble in polar organic solvents, are difficult to produce and process, copolyamides have been developed which possess good solubility in the known amide solvents, which also have good spinning properties and whose filaments, after drawing, are notable for high strength values and initial moduli. Examples of such aromatic copolyamides may be found in DE-C-2,556,883, DE-A-3,007,063, and EP-A-199,090, EP-A-364,891, EP-A-364,892, EP-A-364,893 and EP-A-424,860.

DETAILED DESCRIPTION OF THE INVENTION

It has now been found that the inherently good cut-resistance of fibers composed of such copolyamides can be appreciably improved beyond the expected extent. The cut resistance of such fibers, measured in the cut protection performance test (CCP test), is customarily more than about 8% above that of fibers composed of insoluble amides.

The present invention accordingly provides a cut-resistant fiber comprising a filler having a Mohs hardness of not less than 3 and a fiber-forming material comprising an aromatic polyamide which is soluble in polar aprotic organic solvents and contains the structural repeat units of the formulae I, II and optionally IIa $$—OC—Ar^1—CO—NH—Ar^2—NH— \quad (I)$$

$$—OC—Ar^1—CO—NH—Ar^3—NH— \quad (II)$$

$$—OC—Ar^1—CO—NH—Ar^{3a}—NH— \quad (IIa)$$

where $Ar^1$, $Ar^2$, $Ar^3$ and $Ar^{3a}$ are each independently of the others a bivalent mono- or polycyclic aromatic radical whose free valences are disposed para or meta or comparably parallel, coaxial or angled to each other, and $Ar^2$, $Ar^3$ and optionally $Ar^{3a}$ each have different individual meanings within the scope of the given definitions, and the respective monomer components underlying the polymer are selected so as to produce a soluble aromatic polyamide which forms preferably isotropic solutions in organic solvents.

The polymers to be used in the fibers of this invention are aramids which are essentially formed from pa,a-aromatic monomers and which are soluble in polar aprotic organic solvents.

A soluble aromatic polyamide for the purposes of this invention is any aromatic polyamide which has a solubility in N-methylpyrrolidone of at least 50 g/l at 25° C.

The polar aprotic organic solvent preferably comprises at least one solvent of the amide type, for example N-methyl-2-pyrrolidone, N,N-dimethyl-acetamide, tetra-methylurea, N-methyl-2-piperidone, N,N'-dimethyl-ethyleneurea, N,N,N',N'-tetramethylmaleamide, N-methylcaprolactam, N-acetylpyrrolidine, N,N-diethylacetamide, N-ethyl-2-pyrrolidone, N,N'-dimethylpropionamide, N,N-dimethylisobutylamide, N-methyl-formamide, N,N'-dimethylpropyleneurea. The preferred organic solvents for the process of the present invention are N-methyl-2-pyrrolidone, N,N-dimethylacetamide and a mixture thereof.

The aromatic polyamides (hereinafter also called aromatic copolyamides) to be used for the purposes of this invention are compounds which are soluble in polar aprotic organic solvents, preferably with the formation of isotropic solutions, and which contain at least two, especially three, structural repeat units of the above definition which differ in the diamine units.

Any bivalent aromatic radicals whose valence bonds are disposed para or comparably coaxial or parallel to each other are monocyclic or polycyclic aromatic hydrocarbon radicals or heterocyclic aromatic radicals which can be monocyclic or polycyclic. Heterocyclic aromatic radicals have in particular one or two oxygen, nitrogen or sulfur atoms in the aromatic nucleus.

Polycyclic aromatic radicals can be fused to one another or be bonded linearly to one another via C—C bonds or via —CO—NH— groups.

The valence bonds in mutually coaxial or parallel disposition point in opposite directions. An example of coaxial bonds pointing in opposite directions are the biphenyl-4,4'-ene bonds. An example of parallel bonds pointing in opposite directions are the naphthalene-1,5 or -2,6 bonds, whereas the naphthalene-1,8 bonds are parallel but point in the same direction.

Examples of preferred bivalent aromatic radicals whose valence bonds are disposed para or comparably coaxial or parallel to each other are monocyclic aromatic radicals having free valences disposed para to each other, especially 1,4-phenylene, or bicyclic fused aromatic radicals having parallel bonds pointing in opposite directions, especially 1,4-, 1,5- and 2,6-naphthylene, or bicyclic aromatic radicals linked via a C—C bond but having coaxial bonds pointing in opposite directions, especially 4,4'-biphenylene.

Any bivalent aromatic radicals whose valence bonds are disposed meta or comparably angled to each other are monocyclic or polycyclic aromatic hydrocarbon radicals or heterocyclic aromatic radicals which can be monocyclic or polycyclic. Heterocyclic aromatic radicals have in particular one or two oxygen, nitrogen or sulfur atoms in the aromatic nucleus.

Polycyclic aromatic radicals can be fused to one another or be linked to one another via C—C bonds or via bridging groups, for example —O—, —$CH_2$—, —S—, —CO— or —$SO_2$—.

Examples of preferred bivalent aromatic radicals whose valence bonds are disposed meta or comparably angled to each other are monocyclic aromatic radicals having free valences disposed meta to each other, especially 1,3-phenylene, or bicyclic fused aromatic radicals having mutually angled bonds, in particular 1,6- and 2,7-naphthylene, or bicyclic aromatic radicals linked via a C—C bond and having mutually angled bonds, especially 3,4'-biphenylene.

Minor proportions, for example to 5 mol%, of the monomer units, based on the polymer, can be aliphatic or cycloaliphatic in nature, for example alkylene or cycloalkylene units.

Alkylene is to be understood as meaning branched and especially straight-chain alkylene, for example alkylene having two to four carbon atoms, especially ethylene.

Cycloalkylene radicals are for example radicals having five to eight carbon atoms, especially cyclohexylene.

All these aliphatic, cycloaliphatic or aromatic radicals can be substituted by inert groups. These are substituents which have no adverse effect on the contemplated application.

Examples of such substituents are alkyl, alkoxy or halogen. Alkyl is to be understood as meaning branched and especially straight-chain alkyl, for example alkyl having one to six carbon atoms, especially methyl.

Alkoxy is to be understood as meaning branched and especially straight-chain alkoxy, for example alkoxy having one to six carbon atoms, especially methoxy.

Halogen is for example fluorine, bromine or in particular chlorine.

Preference is given to aromatic polyamides based on unsubstituted radicals.

The dicarboxylic acid unit in the aromatic polyamides containing the structural repeat units of the formulae I, II and optionally III is preferably terephthalic acid.

The preferred cut-resistant fibers comprise particularly aromatic copolyamides containing the structural repeat units of the formulae III and IV or of the formulae III and VI or of the formulae III, IV and V or of the formulae III, IV and VI or of the formulae IV, V and VI $$—OC—Ar^1—CO—NH-Ar^4—NH— \quad (III)$$

$$—OC—Ar^1—CO—NH—Ar^5—Q—Ar^6—NH— \quad (IV)$$

$$—OC-Ar^1—CO—NH—Ar^7—Y—Ar^8—NH— \quad (V)$$

(VI)

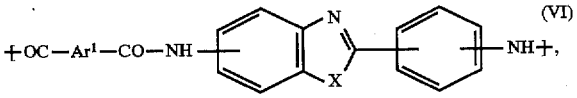

where $Ar^1$ and $Ar^4$ are each independently of the other a bivalent mono- or polycyclic aromatic radical whose free valences are disposed para or comparably parallel or coaxial to each other, and are in particular monocyclic or bicyclic aromatic radicals, $Ar^5$ and $Ar^6$ are each independently of the other a bivalent mono- or polycyclic aromatic radical whose free valences are disposed para or comparably parallel or coaxial to each other, or where $Ar^6$ additionally may be a bivalent mono- or polycyclic aromatic radical whose free valences are disposed meta or comparably angled to each other, Q is a direct C—C bond or a group of the formula —O—, —S—, —$SO_2$—, —O—phenylene—O— or alkylene, $Ar^7$ and $Ar^8$ each have one of the meanings defined for $Ar^5$ and $Ar^6$, Y has one of the meanings defined for Q or may additionally be a group of the formula —HN—CO—, and X is a group of the formula —O—, —S— or in particular —$NR^1$—, where $R^1$ is alkyl, cycloalkyl, aryl, aralkyl or in particular hydrogen.

Particular preference is given to cut-resistant fibers comprising aromatic copolyamides with the structural repeat units of the formulae III, IV and V where $Ar^1$ is 1,4-phenylene, $Ar^4$ is 1,4-phenylene or a bivalent radical of 4,4'-diaminobenzanilide, $Ar^5$, $Ar^6$ and $Ar^7$ are each 1,4-phenylene, $Ar^8$ is 1,3-phenylene, Q is —O—1,4-phenylene—O—, and Y is —O—; and particularly preferably the proportions of the structural repeat units of the formulae III, IV and V vary within the following ranges, based on the total amount of these structural units:

structural repeat unit of the formula III: 40–60 mol%,
structural repeat unit of the formula IV: 1–20 mol%, and
structural repeat unit of the formula V: 15–40 mol%.

Particular preference is likewise given to cut-resistant fibers comprising aromatic copolyamides with the structural repeat units of the formulae III, IV and V where $Ar^1$ is 1,4-phenylene, $Ar^4$ is 1,4-phenylene or a bivalent radical of 4,4'-diaminobenzanilide, $Ar^5$ and $Ar^6$ are each 1,4-phenylene, $Ar^7$ and $Ar^8$ are each methyl-, methoxy- or chlorine-substituted 1,4-phenylene, Q is —O—1,4-phenylene—O— and Y is a direct C—C bond; and particularly 5 preferably the proportions of the structural repeat units of the formulae III, IV and V vary within the following ranges, based on the total amount of these structural units:

structural repeat unit of the formula III: 10–30 mol%,
structural repeat unit of the formula IV: 10–30 mol%, and
structural repeat unit of the formula V: 10–60 mol%.

Particular preference is likewise given to cut-resistant fibers comprising aromatic copolyamides with the structural repeat units of the formulae III, IV and V where $Ar^1$ is 1,4-phenylene, $Ar^4$ is 1,4-phenylene or a bivalent radical of 4,4'-diaminobenzanilide, $Ar^5$ and $Ar^6$ are each 1,4-phenylene, $Ar^7$ and $Ar^8$ are each methyl-, methoxy- or chlorine-substituted 1,4-phenylene, Q is —O— and Y is a direct C—C bond; and particularly preferably the proportions of the structural repeat units of the formulae III, IV and V vary within the following ranges, based on the total amount of these structural units:

structural repeat unit of formula III: 10–30 mol%,
structural repeat unit of formula IV: 10–30 mol%, and
structural repeat unit of formula V: 10–60 mol%.

Particular preference is likewise given to cut-resistant fibers comprising aromatic copolyamides with the structural repeat units of the formulae III and IV where $Ar^1$ is 1,4-phenylene, $Ar^4$ is 1,4-phenylene or a bivalent radical of 4,4'-diaminobenzanilide, $Ar^5$ is 1,4-phenylene, $Ar^6$ is 1,3-phenylene and Q is —O—; and particularly preferably the proportions of the structural repeat units of the formulae III and IV vary within the following ranges, based on the total amount of these structural units: structural repeat unit of formula III: 20–50 mol%, and structural repeat unit of formula IV: 40–60 mol%.

Particular preference is likewise given to cut-resistant fibers comprising aromatic copolyamides with the structural repeat units of the formulae III and VI where $Ar^1$ is 1,4-phenylene, $Ar^4$ is 1,4-phenylene or a bivalent radical of 4,4'-diaminobenzanilide and X is —NH—; and particularly preferably the proportions of the structural repeat units of the formulae III and VI vary within the following ranges, based on the total amount of these structural units:

structural repeat unit of the formula III: 30–70 mol%, and structural repeat unit of the formula VI: 70-30 mol%.

Particular preference is likewise given to cut-resistant fibers comprising aromatic copolyamides with the structural repeat units of the formulae III, IV and VI where $Ar^1$ is 1,4-phenylene, $Ar^4$ is 1,4-phenylene or a bivalent radical of 4,4'-diaminobenzanilide, $Ar^5$ is 1,4-phenylene, $Ar^6$ is 1,4- or 1,3-phenylene, Q is —O— or —O—1,4-phenylene—O— and X is —NH—; and particularly preferably the proportions of the structural repeat units of the formulae III, IV and VI vary within the following ranges, based on the total amount of these structural units:

structural repeat unit of the formula III: 10–30 mol%, structural repeat unit of the formula IV: 10–40 mol%, and structural repeat unit of the formula VI: 50–70 mol%.

Particular preference is likewise given to cut-resistant fibers comprising aromatic copolyamides with the structural repeat units of the formulae IV, V and VI where $Ar^1$ is 1,4-phenylene, $Ar^5$ is 1,4-phenylene, $Ar^6$ is 1,4-phenylene or 1,3-phenylene, Q is —O— or —O —1,4-phenylene—O—, $Ar^7$ and $Ar^8$ are each methyl-, methoxy- or chlorine-substituted 1,4-phenylene, Y is a direct C—C bond and X is —NH—; and particularly preferably the proportions of the structural repeat units of the formulae IV, V and VI vary within the following ranges, based on the total amount of these structural units:

structural repeat unit of the formula IV: 10–40 mol%, structural repeat unit of the formula V: 30–60 mol%, and structural repeat unit of the formula VI: 50–70 mol%.

Examples of preferred diamine combinations underlying these preferred structural repeat units of the formulae III and IV or of the formulae III and VI or of the formulae III, IV and V or of the formulae III, IV and VI are 1,4-phenylenediamine and 3,4'-diaminodiphenyl ether, 1,4-phenylenediamine, 4,4'-diaminodiphenylmethane and 3,3'-dichloro-, 3,3'-dimethyl- or 3,3'-dimethoxy-benzidine; and also 1,4-phenylenediamine, 1,4-bis(aminophenoxy)benzene and 3,3'-dichloro-, 3,3'-dimethyl- or 3,3'-dimethoxy-benzidine; and also 1,4-phenylenediamine, 3,4'-diaminodiphenyl ether and 3,3'-dichloro-, 3,3'-dimethyl- or 3,3'-dimethoxybenzidine; and also 1,4-phenylenediamine, 3,4'-diaminodiphenyl ether and 4,4'-diaminobenzanilide; and also 1,4-phenylenediamine, 1,4-bis(aminophenoxy) benzene and 3,4'-diaminodiphenyl ether; and also 1,4-phenylenediamine and 5(6)-amino-2-(para-aminophenyl) benzimidazole; and also 1,4-phenylenediamine,5(6)-amino-2-(para-aminophenyl)benzimidazole and 3,3'-dichloro-, 3,3'-dimethyl- or 3,3'-dimethoxy-benzidine; and also 1,4-phenylenediamine, 5(6)-amino-2-(para-aminophenyl) benzimidazole and 3,4'-diaminodiphenyl ether; and also 3,3'-dichloro-, 3,3'-dimethyl- or 3,3'-dimethoxy-benzidine, 5(6)-amino-2-(para-aminophenyl) benzimidazole and 1,4-bis(aminophenoxy)benzene; and also 5(6)-amino-2-(para-aminophenyl)benzimidazole, 3,3'-dichloro-, 3,3'-dimethyl- or 3,3'-dimethoxy-benzidine and 3,4'-diaminodiphenyl ether; and also 1,4-phenylenediamine, 5(6)-amino-2-(para-aminophenyl)benzimidazole and 1,4-bis(aminophenoxy) benzene.

Aramids which are derived from such diamine combinations and which are preferably useful for the present invention are in part described in EP-A-199,090, EP-A-364,891, EP-A-364,892, EP-A-364,893 and EP-A-424,860.

The aromatic polyamides to be used according to this invention are known per se.

The polycondensation and the formation of fibers from the coaramids to be used according to this invention are effected by processes known per se, as described for example in the above-cited references. The mixing of the filler and the formation of filler-comprising fibers can be effected for example by the process described in EP-A-662,534.

The aromatic copolyaramids to be used according to this invention must have a molecular weight sufficient for fiber formation. The copolyaramids to be used according to this invention have a sufficient molecular chain length for example when the viscosity of the polymer solution obtained from the polycondensation corresponds to an inherent viscosity of the polymer of more than 2.5 dl/g, preferably 2.5 to 7.0 dl/g.

The inherent viscosity is given by the expression $$\eta_{inh} = \frac{\ln \eta_{rel}}{c}$$

where $\eta_{rel}$ is the relative viscosity and c the concentration in g/100 ml.

For the purposes of the present invention, it is determined on 0.25% strength solutions of polymer in N-methylpyrrolidone at 25° C.

The filler used in the fibers of this invention very generally has a Mohs hardness of not less than 3, preferably not less than 5.

Any material is suitable for use as filler, i.e. semimetals or preferably metals or nonmetals and also alloys of these materials, provided it has the above-defined hardness.

Preferred metals include for example aluminum, iron, nickel, stainless steel, copper, zinc, tantalum, titanium, tungsten or mixtures thereof.

Particular preference is given to metal alloys with tungsten as alloy constituent which have a Mohs hardness of 6.5 to 7.5.

Preferred nonmetals include for example metal oxides, such as aluminum oxide; metal carbides, such as tungsten carbide; metal nitrides, metal silicates, metal sulfates, metal phosphates, metal borides or mixtures thereof. Furthermore, it is also possible to use ceramic materials.

The proportion of filler in the fiber of this invention is in any event chosen to be such that the cut resistance (measured by the CPP test) is increased, for example by at least more than 8%, compared with the unmodified fiber. Surprisingly, the other mechanical properties of the fibers, such as tensile strength or modulus, are only insignificantly impaired by the use of the filler. For instance, the tensile strength of a filled fiber of an increased cut resistance decreases to about 205 cN/tex, compared with about 215 cN/tex for the tensile strength of the untilled fiber.

Typical amounts of filler vary within the range from less than 25% by weight, based on the weight of the fiber, preferably within the range from 0.05 to 20% by weight.

The particle shape of the filler used can be any shape; for example spherical or ellipsoidal or else irregular. The filler is for example mixed in in the form of a powder.

The filler preferably has an average particle diameter of not more than 20 μm, in particular 0.05 to 5 μm.

The term "fibers" is herein to be understood in its widest meaning; it thus encompasses for example staple fibers or in particular filaments of any linear density, including monofilaments.

The fibers of this invention are notable for excellent mechanical properties, such as high breaking strength and initial moduli and low breaking extensions, as well as for the abovementioned increased cut resistance.

The fibers of this invention preferably have filament linear densities of not less than 0.6 dtex, in particular 1 to 20 dtex.

The tensile strength of the fibers of this invention is preferably 150 to 300 cN/tex.

The initial modulus, based on 100% extension, of the fibers of this invention is preferably 20 to 120 N/rex.

The cross-sectional shape of the fibers of this invention can be any shape, for example triangular, tri- or multilobal or in particular elliptical or round.

The fibers of this invention are useful for manufacturing protective clothing, antivandalism textiles and composite materials. The use of the fibers for these purposes likewise forms part of the subject-matter of the present invention.

The fibers of this invention are generally used in the form of yarns. The yarns in question can be yarns produced by secondary spinning or are preferably multifilament yarns. Typical yarn linear densities vary within the range from 50 to 9000 dtex.

Yarns comprising the fibers of this invention likewise form part of the subject-matter of the present invention.

A preferred embodiment comprises yarns comprising blends of fibers of this invention and fibers composed of inorganic materials, such as glass, boron, carbon, metals or ceramic materials. Such blend yarns are notable for still higher cut-resistance.

The Example which follows illustrates the invention without limiting it.

EXAMPLE 1

A fiber consisting of an aromatic copolyamide derived from terephthaloyl chloride, 50 mol% of 3,3'-dimethylbenzidine, 25 mol% of p-phenylene-diamine and 25 mol% of 1,4-bis(4-aminophenoxy)benzene and of 0.5% by weight of aluminum oxide was compared with an unfilled fiber composed of the same aromatic copolyamide as regards tensile strength and cut resistance. The following values were determined:

| | Cut resistance (CPP test) [ounce per squ. yard] | Tensile strength [cN/tex] |
|---|---|---|
| unfilled fiber | 96 | 212 |
| filled fiber | 110 | 203 |

What is claimed is:

1. A cut-resistant fiber comprising a filler having a Mohs hardness of at least 3 and a fiber-forming material comprising an aromatic polyamide which is soluble in polar aprotic organic solvents and contains the structural repeat units of the formulae I, II and optionally IIa $$—OC—Ar^1—CO—NH—Ar^2—NH— \quad (I)$$

$$—OC—Ar^1—CO—NH—Ar^3—NH— \quad (II)$$

$$—OC—Ar^1—CO—NH—Ar^{3a}—NH— \quad (IIa),$$

where $Ar^1$, $Ar^2$, $Ar^3$ and $Ar^{3a}$ are each independently of the others a bivalent mono- or polycyclic aromatic radical whose free valences are disposed para or meta or comparably parallel, coaxial or angled to each other, and $Ar^2$, $Ar^3$ and optionally $Ar^{3a}$ each have different individual meanings within the scope of the given definitions, and the respective monomer components underlying the polymer are selected so as to produce a soluble aromatic polyamide which forms preferably isotropic solutions in organic solvents.

2. The cut-resistant fiber of claim 1 wherein the aromatic polyamide contains the structural repeat units of the formulae III and IV or of the formulae III and VI or of the formulae III, IV and V or of the formulae III, IV and VI or of the formulae IV, V and VI $$—OC—Ar^1—CO—NH—Ar^4—NH— \quad (III)$$

$$—OC—Ar^1—CO—NH—Ar^5—Q—Ar^6—NH— \quad (IV)$$

$$—OC—Ar^1—CO—NH—Ar^7—Y—Ar^8—NH— \quad (V)$$

(VI)

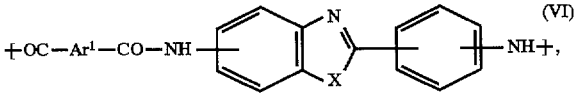

where $Ar^1$ and $Ar^4$ are each independently of the other a bivalent mono- or polycyclic aromatic radical whose free valences are disposed para or comparably parallel or coaxial to each other, and are in particular monocyclic or bicyclic aromatic radicals, $Ar^5$ and $Ar^6$ are each independently of the other a bivalent mono- or polycyclic aromatic radical whose free valences are disposed para or comparably parallel or coaxial to each other, or where $Ar^6$ additionally may be a bivalent mono- or polycyclic aromatic radical whose free valences are disposed meta or comparably angled to each other, Q is a direct C—C bond or a group of the formula —O—, —S—, —$SO_2$—, —O—phenylene—O— or alkylene, $Ar^7$ and $Ar^8$ each have one of the meanings defined for $Ar^5$ and $Ar^6$, Y has one of the meanings defined for Q or may additionally be a group of the formula —HN—CO—, and X is a group of the formula —O—, —S— or in particular —$NR^1$—, where $R^1$ is alkyl, cycloalkyl, aryl, aralkyl or in particular hydrogen.

3. The cut-resistant fiber of claim 2 wherein aromatic copolyamides contain the structural repeat units of the formulae III, IV and V where $Ar^1$ is 1,4-phenylene, $Ar^4$ is 1,4-phenylene or a bivalent radical of 4,4'-diaminobenzanilide, $Ar^5$, $Ar^6$ and $Ar^7$ are each 1,4-phenylene, $Ar^8$ is 1,3-phenylene, Q is —O—1,4-phenylene—O— and Y is —O—; and the proportions of the structural repeat units of the formulae III, IV and V preferably vary within the following ranges, based on the total amount of these structural units:

structural repeat unit of the formula III: 40–60 mol%, structural repeat unit of the formula IV: 1–20 mol%, and structural repeat unit of the formula V: 15–40 mol%.

4. The cut-resistant fiber of claim 2 wherein the aromatic copolyamides contain the structural repeat units of the formulae III, IV and V where $Ar^1$ is 1,4-phenylene, $Ar^4$ is 1,4-phenylene or a bivalent radical of 4,4'-diaminobenzanilide, $Ar^5$ and $Ar^6$ are each 1,4-phenylene, $Ar^7$ and $Ar^8$ are each methyl-, methoxy- or chlorine-substituted 1,4-phenylene, Q is —O—1,4-phenylene—O— and Y is a direct C—C bond; and the proportions of the structural repeat units of the formulae III, IV and V preferably vary within the following ranges, based on the total amount of these structural units:

structural repeat unit of the formula III: 10–30 mol%, structural repeat unit of the formula IV: 10–30 mol%, and structural repeat unit of the formula V: 10–60 mol%.

5. The cut-resistant fiber of claim 2 wherein the aromatic copolyamides contain the structural repeat units of the formulae III, IV and V where $Ar^1$ is 1,4-phenylene, $Ar^4$ is 1,4-phenylene or a bivalent radical of 4,4'-diaminobenzanilide, $Ar^5$ and $Ar^6$ are each 1,4-phenylene, $Ar^7$ and $Ar^8$ are each methyl-, methoxy- or chlorine-substituted 1,4-phenylene, Q is —O— and Y is a direct C—C bond; and the proportions of the structural repeat units of the formulae III, IV and V preferably vary within the following ranges, based on the total amount of these structural units:

structural repeat unit of formula III: 10–30 mol%, structural repeat unit of formula IV: 10–30 mol%, and structural repeat unit of formula V: 10–60 mol%.

6. The cut-resistant fiber of claim 2 wherein the aromatic copolyamides contain the structural repeat units of the formulae III and IV where $Ar^1$ is 1,4-phenylene, $Ar^4$ is 1,4-phenylene or a bivalent radical of 4,4'-diaminobenzanilide, $Ar^5$ is 1,4-phenylene, $Ar^6$ is 1,3-phenylene and Q is —O—; and the proportions of the structural repeat units of the formulae III and IV preferably vary within the following ranges, based on the total amount of these structural units:

structural repeat unit of the formula III: 20–50 mol%, and structural repeat unit of the formula IV: 40–60 tool%.

7. The cut-resistant fiber of claim 2 wherein the aromatic copolyamides contain the structural repeat units of the formulae III and VI where $Ar^1$ is 1,4-phenylene, $Ar^4$ is 1,4-phenylene or a bivalent radical of 4,4'-diaminobenzanilide and X is —NH—; and the proportions of the structural repeat units of the formulae III and VI preferably vary within the following ranges, based on the total amount of these structural units:

structural repeat unit of the formula III: 30–70 mol%, and structural repeat unit of the formula VI: 70-30 mol%.

8. The cut-resistant fiber of claim 2 wherein the aromatic copolyamides contain the structural repeat units of the formulae III, IV and VI where $Ar^1$ is 1,4-phenylene, $Ar^4$ is 1,4-phenylene or a bivalent radical of 4,4'-diaminobenzanilide, $Ar^5$ is 1,4-phenylene, $Ar^6$ is 1,4- or 1,3-phenylene, Q is —O— or —O—1,4-phenylene—O— and X is —NH—; and the proportions of the structural repeat units of the formulae III, IV and VI preferably vary within the following ranges, based on the total amount of these structural units:

structural repeat unit of formula III: 10–30 mol%, structural repeat unit of the formula IV: 10–40 mol%, and structural repeat unit of the formula VI: 50–70 mol%.

9. The cut-resistant fiber of claim 2 wherein the aromatic copolyamides contain the structural repeat units of the formulae IV, V and VI where $Ar^1$ is 1,4-phenylene, $Ar^5$ is 1,4-phenylene, $Ar^6$ is 1,4-phenylene or 1,3-phenylene, Q is —O— or —O—1,4-phenylene—O—, $Ar^7$ and $Ar^8$ are each methyl-, methoxy- or chlorine-substituted 1,4-phenylene, Y is a direct C—C bond, and X is —NH—; and the proportions of the structural repeat units of the formulae IV, V and VI preferably vary within the following ranges, based on the total amount of these structural units:

structural repeat unit of the formula IV: 10–40 mol%, structural repeat unit of the formula V: 30–60 mol%, and structural repeat unit of the formula VI: 50–70 mol%.

10. The cut-resistant fiber of claim 1, wherein the filler is present in the fiber in an amount of 0.05 to 20% by weight.

11. The cut-resistant fiber of claim 1, wherein the filler has a Mohs hardness is at least 5.

12. The cut-resistant fiber of claim 1, wherein the filler has an average particle diameter of not more than 20 μm.

13. The cut-resistant fiber of claim 1, wherein the filler has the shape of an ellipsoid which has an average particle diameter of not more than 20 μm.

14. The cut-resistant fiber of claim 1, wherein the filler is a metal and/or a metal alloy, preferably aluminum, iron, nickel, stainless steel, copper, zinc, tantalum, titanium, tungsten or a mixture thereof.

15. The cut-resistant fiber of claim 1, wherein the filler is a nonmetal, preferably a metal oxide, metal carbide, metal nitride, metal silicate, metal sulfate, metal phosphate, metal boride or a mixture thereof.

16. The cut-resistant fiber of claim 1 having a filament linear density of 1 to 20 dtex.

17. A yarn comprising the fibers of claim 1.

18. A yarn comprising a blend of fibers of claim 1 and fibers composed of inorganic materials, wherein said fibers of claim 1 have a filament linear density of 1 to 20 dtex.

19. The yarn of claim 17, wherein the fibers which are composed of inorganic materials are fibers composed of glass, boron, carbon, metals or ceramic materials.

* * * * *

UNITED STATES PATENT AND TRADEMARK OFFICE

CERTIFICATE OF CORRECTION

PATENT NO. : 5,738,940
DATED : April 14, 1998
INVENTOR(S) : Richard Neuert

It is certified that error appears in the above-indentified patent and that said Letters Patent is hereby corrected as shown below:

Column 2, line 22, "pa.a-aromatic" should read -- para-aromatic --.

Column 4, line 40, delete "5".

Column 7, line 12, "N/rex" should read -- N/tex --.

Column 9, line 29 (claim 6, line 11), "tool%" should read -- mol % --.

Signed and Sealed this

Twenty-eighth Day of July, 1998

*Attest:*

BRUCE LEHMAN

*Attesting Officer*

*Commissioner of Patents and Trademarks*